US010746489B1

(12) United States Patent
Huang

(10) Patent No.: US 10,746,489 B1
(45) Date of Patent: Aug. 18, 2020

(54) SAFETY SELECTOR LEVERS WITH VISUALLY DISTINGUISHABLE ELEMENT

(71) Applicant: BattleArms IP, LLC, Henderson, NV (US)

(72) Inventor: George Huang, Henderson, NV (US)

(73) Assignee: Battlearms IP, LLC, Henderson, NV (US)

( * ) Notice: Subject to any disclaimer, the term of this patent is extended or adjusted under 35 U.S.C. 154(b) by 0 days.

(21) Appl. No.: 16/735,161

(22) Filed: Jan. 6, 2020

(51) Int. Cl.
*F41A 19/46* (2006.01)
*F41A 35/00* (2006.01)
*F41A 17/00* (2006.01)

(52) U.S. Cl.
CPC ..... *F41A 17/00* (2013.01); *F41A 19/46* (2013.01); *F41A 35/00* (2013.01)

(58) Field of Classification Search
CPC ..... F41A 19/46; F41A 19/33; F41A 17/46; F41A 17/56; F41A 35/00
USPC ..... 89/128, 142, 148; D22/108; 42/70.05, 42/70.06, 131, 132, 144, 145
See application file for complete search history.

(56) References Cited

U.S. PATENT DOCUMENTS 985,181 A * 2/1911 Korrodi ..... F41G 1/02 42/144
4,433,610 A * 2/1984 Tatro ..... F41A 17/16 89/148
5,251,533 A * 10/1993 Layton ..... F41A 19/33 89/129.02
D639,378 S * 6/2011 Burt ..... D22/108
8,276,502 B1 * 10/2012 Wright ..... F41A 17/46 42/70.01
D723,646 S * 3/2015 Keezer ..... D22/108
9,587,897 B1 * 3/2017 Huang ..... F41A 17/74
D856,457 S * 8/2019 Montes ..... D22/108
10,466,002 B1 * 11/2019 Geissele ..... F41A 17/46
2014/0259846 A1 * 9/2014 Joubert ..... F41A 17/56 42/70.11

OTHER PUBLICATIONS

Eric B., "[SHOT 2019] Night Fision—Tritium AR15 Night Safety Switch", Jan. 23, 2019, TheFirearmBlog, all pages, <https://www.thefirearmblog.com/blog/2019/01/23/shot-2019-night-fision-tritium-ar15-night-safety-switch/>. (Year: 2019).*

* cited by examiner

*Primary Examiner* — Jonathan C Weber
(74) *Attorney, Agent, or Firm* — Shaddock Law Group, PC

(57) ABSTRACT

A safety selector lever, including at least some of a lever element having a head portion and an extension portion, the extension portion includes an extension portion top wall, two extension portion sidewalls, and an extension portion bottom wall, a visual element recess is formed through at least a portion of the extension portion, at least a primary viewing aperture extends from the extension portion top wall to at least a portion of the visual element recess, and a securing screw aperture extends from the extension portion bottom wall to the visual element recess; a visual element is at least partially positionable within the visual element recess; and a securing screw is rotatably engageable within at least a portion of the securing screw aperture, such that a terminal end of the securing screw extends to contact at least a portion of the visual element within the visual element recess.

17 Claims, 12 Drawing Sheets

SAFETY SELECTOR LEVERS WITH VISUALLY DISTINGUISHABLE ELEMENT

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of firearms. More specifically, the present disclosure relates generally to the field of firearms and is particularly directed to improved safety selector levers for firearms.

2. Description of Related Art

Many modem firearms are provided with a rotatable safety selector, which is movable between a first, or "SAFE" position, in which a lock member blocks movement of a portion of the firearm's firing mechanism, such as the trigger or the hammer, and a second, or "FIRE" position, in which the lock member is rotated to allow firing of the firearm. In the case of fully automatic firearms, the safety selector is also movable to a third position, in which the lock member is rotated to allow for burst or fully automatic firing of the firearm.

The position of the safety selector is determined visually or tactilely. In low light or darkness, it can be difficult or impossible to visually determine the position of the safety selector.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY AND OBJECTS OF THE DISCLOSURE

Unfortunately, there is no current design that efficiently illuminates a portion of the safety selector lever or otherwise allows for visual determination of the position of the safety selector in low light or darkness. This and/or other disadvantages of the prior art are overcome with the presently disclosed safety selector levers, which allow at least a portion of the safety selector lever to be visually distinguishable, so as to allow for improved visual determination of the position of the safety selector. In various exemplary embodiments, at least a portion of the safety selector lever may be illuminated such that at least a portion of the safety selector is more easily visible in low light or darkness.

These advantages of the present disclosure are preferably attained by providing a variety of safety selector levers.

The safety selector levers of the present disclosure overcomes the disadvantages of the conventional safety selector and achieves the above-mentioned objectives through the employment of safety selector levers, which are characterized by comprising.

In various exemplary, non-limiting embodiments, the present disclosure comprises a safety selector lever having a lever element having a head portion and an extension portion, wherein the head portion includes an attachment element, wherein the extension portion includes an extension portion top wall, two extension portion sidewalls, and an extension portion bottom wall, wherein a visual element recess is formed through at least a portion of the extension portion, wherein a primary viewing aperture extends from the extension portion top wall to at least a portion of the visual element recess, and wherein a securing screw aperture extends from the extension portion bottom wall to the visual element recess; a visual element, wherein the visual element is at least partially positionable within the visual element recess; and a securing screw rotatably engageable within at least a portion of the securing screw aperture, such that a terminal end of the securing screw extends to contact at least a portion of the visual element within the visual element recess.

In certain exemplary embodiments, the attachment element is defined by one or more recess sidewalls and a recess bottom wall.

In certain exemplary embodiments, the attachment element is mateable with a portion of a selector core.

In certain exemplary embodiments, the extension portion extends from the head portion.

In certain exemplary embodiments, a portion of the extension portion overlaps at least a portion of the head portion.

In certain exemplary embodiments, a plurality of diagonal grooves are formed within a portion of the extension portion sidewalls of the lever element.

In certain exemplary embodiments, the visual element recess extends through the entire extension portion, along the longitudinal axis of the extension portion.

In certain exemplary embodiments, the visual element recess extends along the longitudinal axis of the extension portion.

In certain exemplary embodiments, at least a portion of a sidewall of the visual element recess includes a surface preparation that provides a reflective or partially reflective surface.

In certain exemplary embodiments, the visual element provides illumination by photoluminescence, phosphorescence, fluorescence, or chemiluminescence. The visual element may optionally comprise a self-illuminating material. Alternatively, the visual element optionally comprises tritium or tritium gas, encased within a cylinder. In still other exemplary embodiments, the visual element optionally comprises a fiber optic strand or cylinder.

In certain exemplary embodiments, the primary viewing aperture extends so as to allow light from the visual element, when positioned within the visual element recess, to emanate or radiate from the visual element recess, through the primary viewing aperture.

In certain exemplary embodiments, the safety selector lever further includes one or more secondary viewing apertures, wherein each secondary viewing aperture extends from one or both of the extension portion sidewalls to at least a portion of the visual element recess. The secondary viewing apertures extend so as to allow light from the visual element, when positioned within the visual element recess, to emanate or radiate from the visual element recess, through the secondary viewing apertures.

In various exemplary, non-limiting embodiments, the present disclosure comprises a safety selector lever having a lever element having an extension portion, wherein the extension portion includes an extension portion top wall, two extension portion sidewalls, and an extension portion bottom wall, wherein a visual element recess is formed through at least a portion of the extension portion, wherein a primary viewing aperture extends from the extension portion top wall to at least a portion of the visual element recess, wherein at least one secondary viewing aperture extends from one or both of the extension portion sidewalls to at least a portion of the visual element recess, and wherein a securing screw aperture extends from the extension portion bottom wall to the visual element recess; a visual element, wherein the visual element is at least partially, removably positioned within the visual element recess; and a securing screw rotatably engageable within at least a portion of the securing screw aperture, such that a terminal end of the securing screw extends to contact at least a portion of the visual element.

In certain exemplary embodiments, the visual element comprises a self-illuminating material or a fiber optic material. The visual element may optionally provide illumination by photoluminescence, phosphorescence, fluorescence, or chemiluminescence.

In certain exemplary embodiments, the visual element comprises a rod or element having a luminous phosphorescent paint applied to at least a portion of the exterior surface of the rod or element.

In certain exemplary embodiments, the visual element comprises a non-luminescent rod or element. The visual element may optionally be colored or at least partially colored to provide a visually discernible contrast between the visual element and other surfaces of the safety selector lever. The visual element may optionally comprise a material, such as, for example, steel, stainless steel, copper, brass, or the like, which provides a visually discernible contrast between the visual element and other surfaces of the safety selector lever.

In various exemplary, non-limiting embodiments, the present disclosure comprises a safety selector lever having a lever element having a head portion and an extension portion, wherein the head portion includes an attachment element, wherein the extension portion includes an extension portion top wall and two extension portion sidewalls, wherein a visual element recess is formed through at least a portion of the extension portion, wherein the visual element recess extends from the extension portion top wall toward the extension portion bottom wall; and a visual element, wherein the visual element is at least partially positioned within the visual element recess.

Accordingly, the presently disclosed systems, methods, and/or apparatuses separately and optionally provide improved safety selectors for firearms.

In various exemplary, nonlimiting embodiments, the presently disclosed systems, methods, and/or apparatuses separately and optionally provide improved safety selectors for firearms, which are at least partially illuminated.

In various exemplary, nonlimiting embodiments, the presently disclosed systems, methods, and/or apparatuses separately and optionally provide improved safety selector levers for firearms, which can be visually identified in low light or darkness.

In various exemplary, nonlimiting embodiments, the presently disclosed systems, methods, and/or apparatuses separately and optionally provide improved safety selector levers for firearms, which include an illumination insert.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the present disclosure discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

As detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE PRESENT DISCLOSURE

Figure 1:
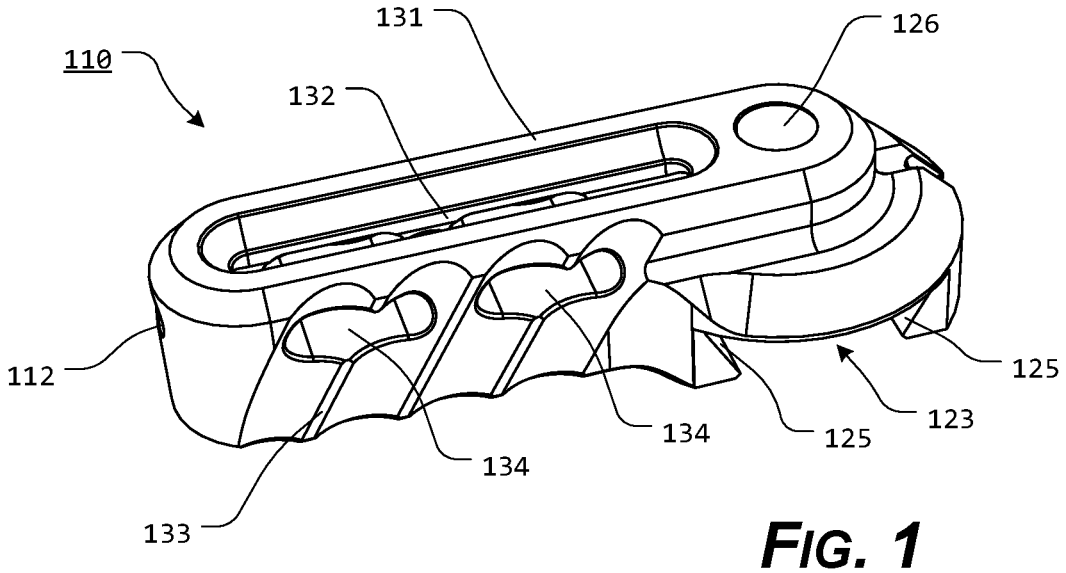
FIG. 1 illustrates an upper, side perspective view of an exemplary embodiment of a safety selector lever element, according to the present disclosure.
Figure 2:
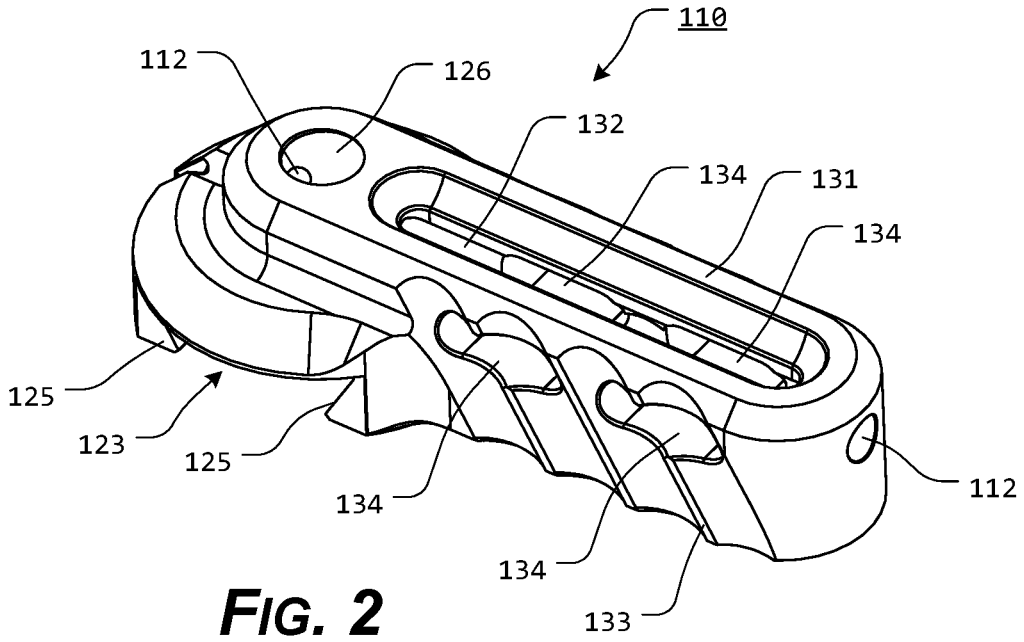
FIG. 2 illustrates an upper, rear perspective view of an exemplary embodiment of a safety selector lever element, according to the present disclosure.
Figure 3:
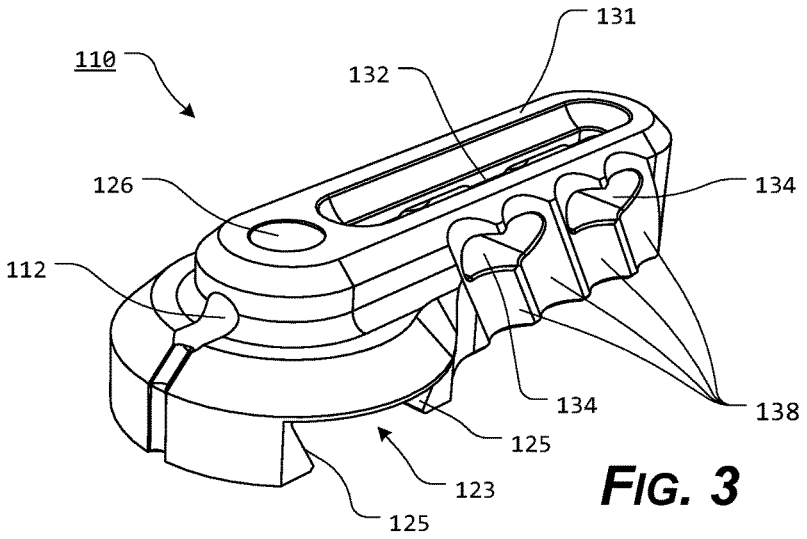
FIG. 3 illustrates an upper, front perspective view of an exemplary embodiment of a safety selector lever element, according to the present disclosure.
Figure 4:
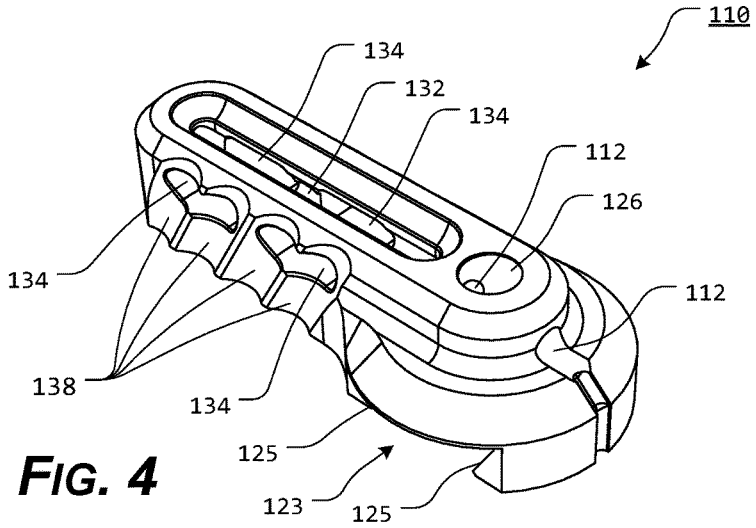
FIG. 4 illustrates an upper, front perspective view of an exemplary embodiment of a safety selector lever element, according to the present disclosure.
Figure 5:
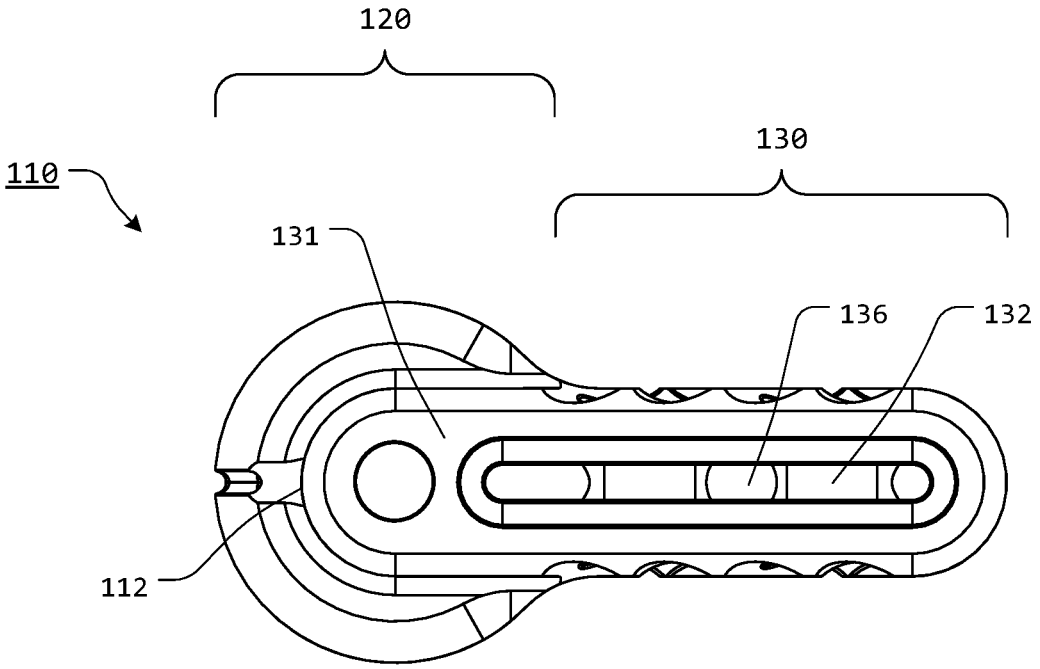
FIG. 5 illustrates a top view of an exemplary embodiment of a safety selector lever element, according to the present disclosure.
Figure 6:
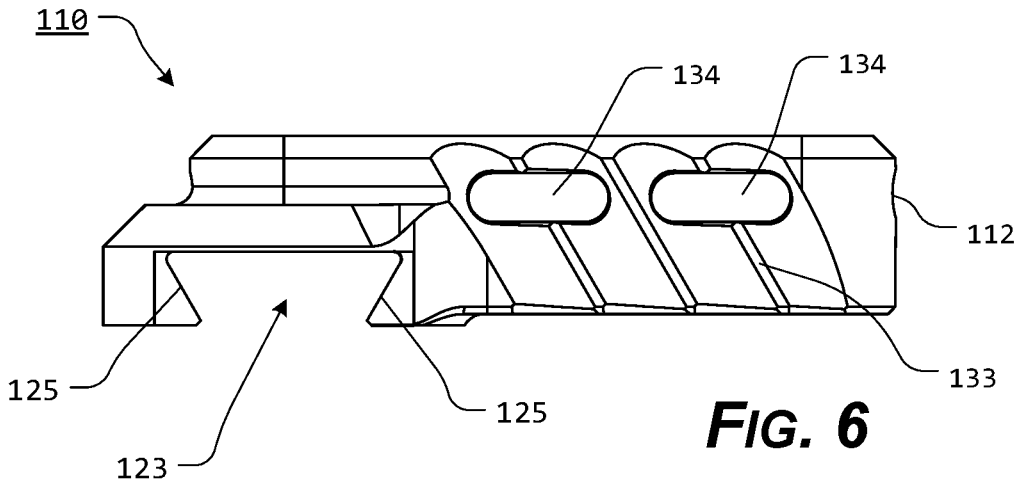
FIG. 6 illustrates a side view of an exemplary embodiment of a safety selector lever element, according to the present disclosure.
Figure 7:
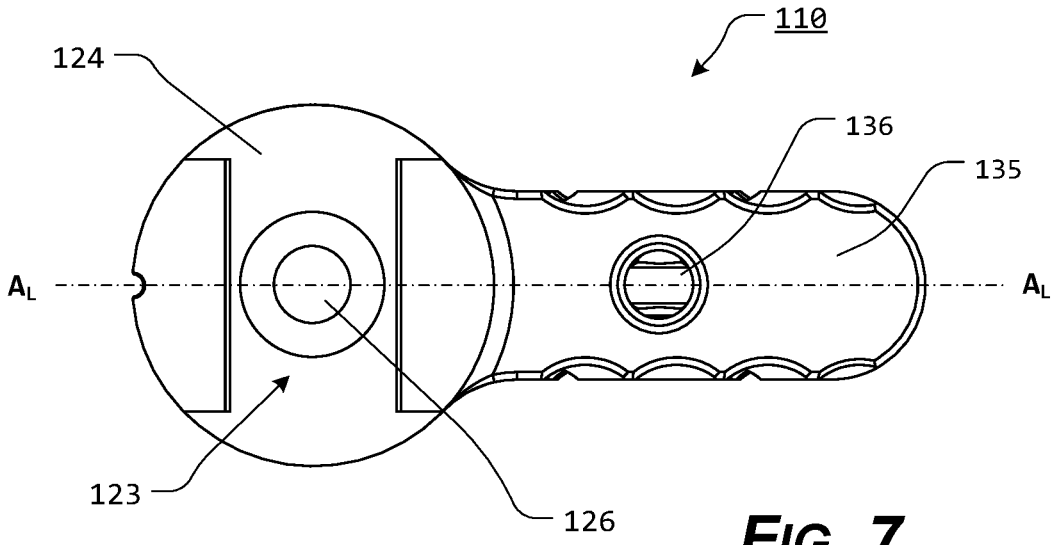
FIG. 7 illustrates a bottom view of an exemplary embodiment of a safety selector lever element, according to the present disclosure.
Figure 8:
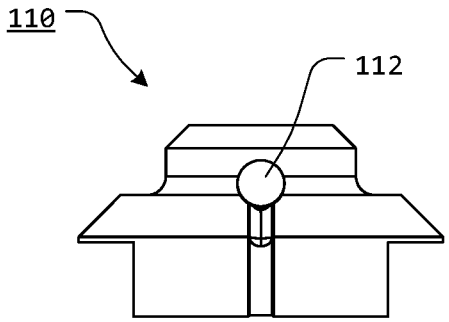
FIG. 8 illustrates a front view of an exemplary embodiment of a safety selector lever element, according to the present disclosure.
Figure 9:
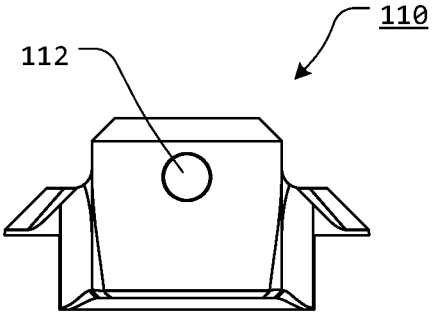
FIG. 9 illustrates a rear view of an exemplary embodiment of a safety selector lever element, according to the present disclosure.
Figure 10:
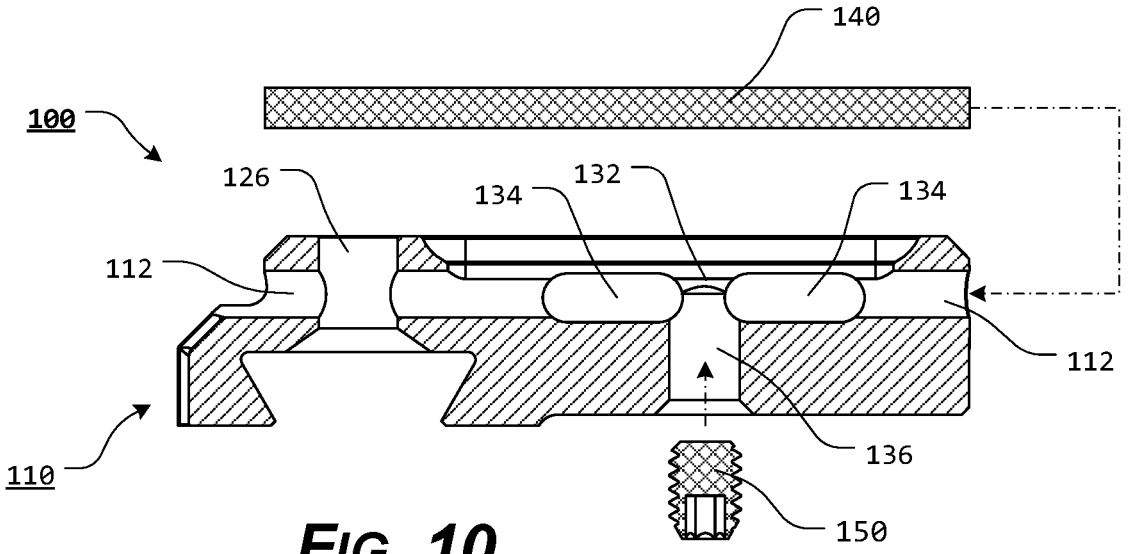
FIG. 10 illustrates a side, cross-sectional, exploded view of an exemplary embodiment of a safety selector lever, according to the present disclosure.
Figure 11:
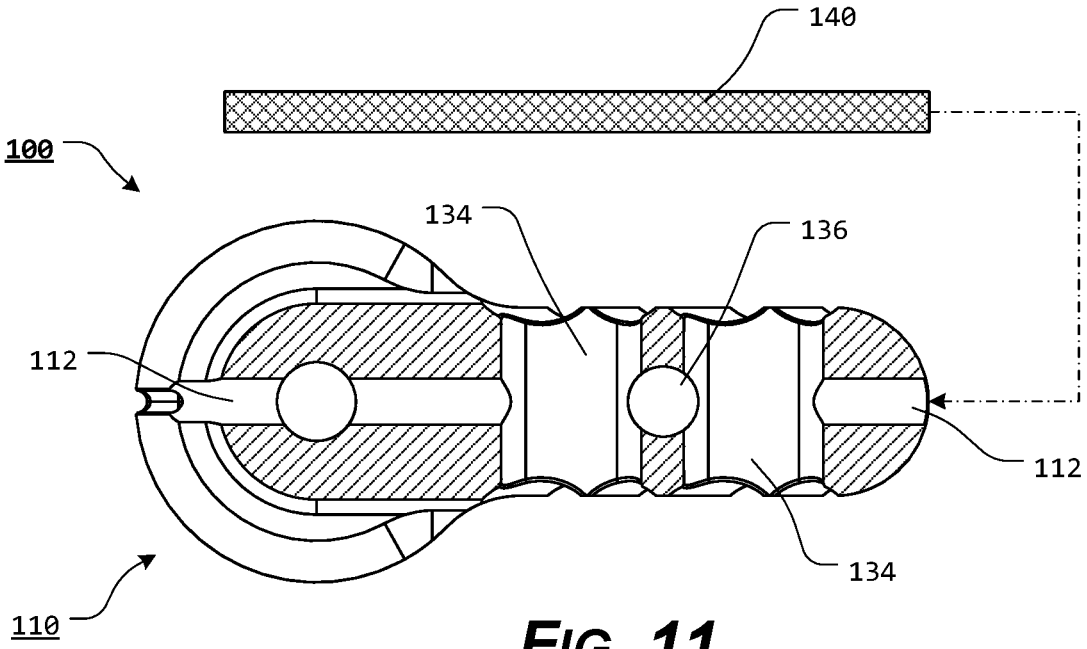
FIG. 11 illustrates a top, cross-sectional, exploded view of an exemplary embodiment of a safety selector lever, according to the present disclosure.
Figure 12:
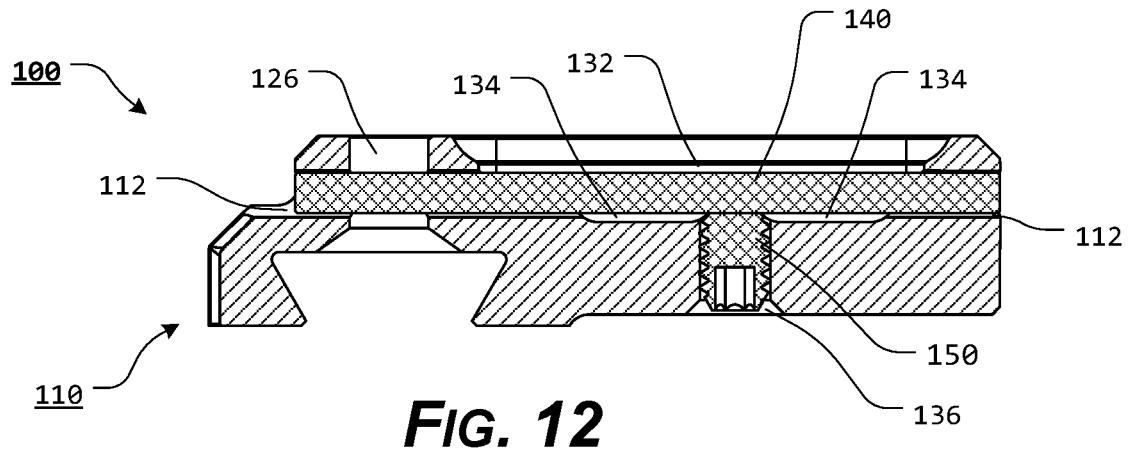
FIG. 12 illustrates a side, cross-sectional, view of an exemplary embodiment of an assembled safety selector lever, according to the present disclosure.
Figure 13:
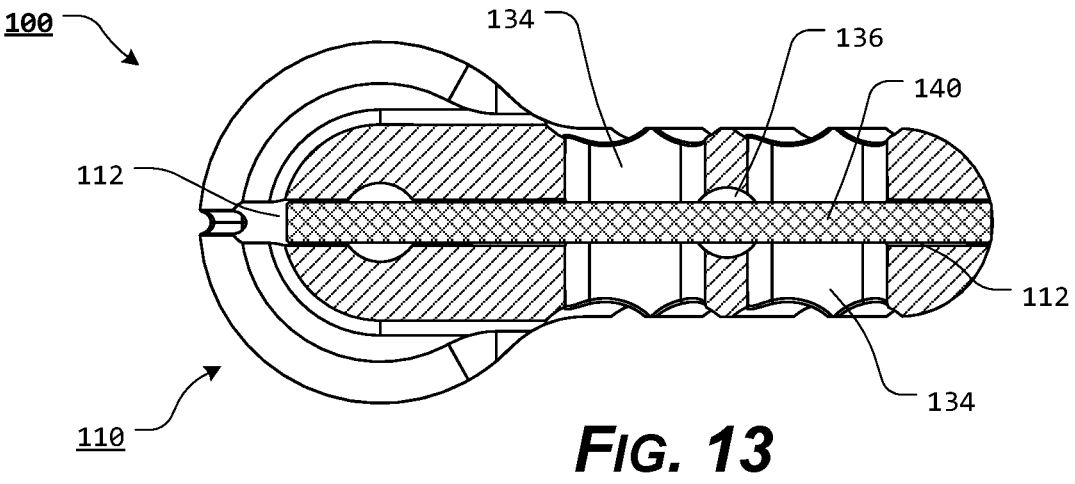
FIG. 13 illustrates a side, cross-sectional, view of an exemplary embodiment of an assembled safety selector lever, according to the present disclosure.

The foregoing and other objectives, features, and advantages of the invention will be more readily understood upon consideration of the following description of the invention taken in conjunction with the accompanying drawings.

For simplicity and clarification, the design factors and operating principles of the safety selector levers according to the present disclosure are explained with reference to various exemplary embodiments of safety selector levers according to the present disclosure. The basic explanation of the design factors and operating principles of the safety selector levers is applicable for the understanding, design, and operation of the safety selector levers of the present disclosure. It should be appreciated that the safety selector levers can be adapted to many applications where a safety selector lever is necessary or desirable.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "illuminated", "visually distinguishable", "safety selector", "lever", and "firearm" are used for basic explanation and understanding of the operation of the systems, methods, and apparatuses of the present disclosure. Therefore, the terms "illuminated", "visually distinguishable", "safety selector", "lever", and "firearm" are not to be construed as limiting the systems, methods, and apparatuses of the present disclosure.

For simplicity and clarification, the safety selector levers of the present disclosure will be described as being used as a safety selector lever for an AR-15 or M4 style firearm. However, it should be appreciated that these are merely exemplary embodiments of the safety selector levers and are not to be construed as limiting the present disclosure. Thus, the safety selector levers of the present disclosure may be utilized in connection with any firearm or other device using a safety selector lever.

Turning now to the drawing FIGS., FIGS. 1-17 illustrate certain components, elements, and/or aspects of certain exemplary embodiments of the safety selector lever 100, according to the present disclosure, while FIGS. 18-27 illustrate certain components, elements, and/or aspects of certain exemplary embodiments of the safety selector lever 200, according to the present disclosure.

In illustrative, non-limiting embodiment(s) of the present disclosure, the safety selector lever 100 comprises at least some of a lever element 110 and a visual element 150. The lever element 110 includes a head portion 120 and an extension portion 130.

As illustrated, the head portion 120 includes at least some of an attachment element 123 formed within a portion of the head portion 120. The attachment element 123 is defined by at least one or more recess sidewalls 125 and a recess bottom wall 124. At least a portion of the attachment element 123 is formed so as to be slidably or otherwise mateable with portions of a projection of a selector core.

In this manner, interaction between the attachment element 123 and the projection of the selector core ensure that the lever element 110 is rotated with the selector core. Thus, the interaction of the selector core and the attachment element 123 ensures that the selector core and the lever element 110 do not rotate separate or apart from one another and rotational movement of the lever element 110 is transmitted directly to the selector core.

In the illustrated embodiment, a compression screw aperture 126 is formed through the recess bottom wall 124 of the lever element 110. Typically, the compression screw aperture 126 is formed within the head portion 120 and is centered relative to the attachment element 123. In various exemplary embodiments, the compression screw aperture 126 includes a tapered portion as the compression screw aperture 126 extends from the attachment element 123. In this manner, a portion of a compression screw is able to be centered relative to the compression screw aperture 126.

When the projection of the selector core and the attachment element 123 are appropriately aligned, the attachment element 123 is appropriately mated with the projection of the selector core. Thus, a hex key (or other appropriate driver or device) is capable of being positioned through the compression screw aperture 126 to interact with a compression screw to maintain an appropriately aligned positioned between the selector core and the lever element 110 and resist slidable movement of the lever element 110 relative to the selector core.

While this exemplary embodiment of the head portion is illustrated and described, it should be appreciated that the safety selector lever 100 of the present disclosure is not so limited. Therefore, it should be understood that the head portion 120 may include any presently known or later discovered attachment or coupling device or system for attaching or coupling the safety selector lever 100 to a desired selector core. Thus, a projection, extension, or recess may extend from or be formed in a portion of the head portion 120 so as to allow the safety selector lever 100 to be attached or coupled to a selector core.

The extension portion 130 includes an extension portion top wall 131, extension portion sidewalls 133, and an extension portion bottom wall 135.

In various exemplary embodiments, the extension portion 130 extends from the head portion 120. Alternatively, at least a portion of the extension portion 130 may overlap at least a portion of the head portion 120. As illustrated by comparing the lever element 110 in FIGS. 1-13 and the lever element 110' in FIGS. 14-15, the length of the extension portion 130 may be varied such that the extension portion 130 may be comparatively longer or shorter, depending upon the desired application.

It should also be appreciated that various extension portions 130 may include different features, when compared to one another. For example, by altering the length, thickness, or configuration of the extension portion 130, a user may be able to select a lever element 110 that is most satisfactory to the shooter. Thus, a plurality of interchangeable lever elements 110 may be provided and a desired lever element 110 may utilized in conjunction with a selector lever core (not shown).

In certain exemplary embodiments, a plurality of diagonal grooves 138 are formed within a portion of the extension portion sidewalls 133 of the lever element 110. The grooves 138, if included, serve to provide texturing to portions of the extension portion 130 to prevent a user's finger from slipping off the extension portion 130 of the lever element 110.

A visual element recess 112 is formed through at least a portion of the extension portion 130. In various exemplary embodiments, the visual element recess 112 extends, from an open first end to an open second end, through the entire extension portion 130, along the longitudinal axis, $A_L$, of the extension portion 130. The visual element recess 112 is formed so as to accept all or at least a portion of a visual element 140 therein. In various exemplary embodiments, the cross-section of the visual element recess 112 is substantially cylindrical.

In certain exemplary embodiments, at least a portion of the sidewall of the visual element recess 112 may include a surface preparation, such as, for example, chrome lining, that provides a reflective or partially reflective surface to enhance the emanation or radiation of the light from the visual element 140.

A securing screw aperture 136 extends from the extension portion bottom wall 135 to the visual element recess 112. The securing screw aperture 136 is at least partially internally threaded. The internal threading of the securing screw aperture 136 is formed so as to allow interaction between the internal threads of the securing screw aperture 136 and external threads of the securing screw 150, such that the securing screw 150 can be repeatably threadably rotated between a disengaged position and an engaged position (as illustrated, for example, in FIG. 12). The securing screw aperture 136 extends so as to allow an entire securing screw 150 to be received therein, such that when the securing screw 150 is in the engaged position, a terminal end of the securing screw 150 extends so as to contact and engage at least a portion of a visual element 140 positioned within the visual element recess 112.

In various exemplary embodiments, the securing screw 150 is similar to a threaded head plug. In various exemplary embodiments, the securing screw 150 comprises a hex head socket threaded plug, such as, for example, a 4-48 set screw. It should be appreciated that other threaded plugs may be utilized, but by utilizing a securing screw 150 similar to a hex head socket threaded plug, a hex key, Allen key, or other similar device can be used to engage and rotate the securing screw 150.

The securing screw 150 may optionally include a portion of Teflon, rubber, or other material extending from the terminal end of the securing screw 150. In this manner, the chance of the securing screw 150 marring or damaging the visual element 140 is reduced.

In various exemplary, nonlimiting embodiments, the visual element 140 may optionally transmit light either by self-illumination or by concentrating ambient light. In various exemplary embodiments, the visual element 140 may comprise a substance which can absorb energy and release the energy in the form of light. For example, the visual element 140 may optionally provide illumination by photoluminescence, phosphorescence, fluorescence, chemiluminescence. In certain exemplary embodiments, the visual element 140 may comprise a self-illuminating material, such as, for example, tritium or tritium gas, encased within a cylinder. Alternatively, the visual element 140 may comprise a fiber optic strand or cylinder that is able to collect ambient light and concentrate the collected light to "glow". In various exemplary embodiments, the visual element 140 takes the form of an elongate or elongated cylinder. However, it should be appreciated that the overall size and shape of the visual element 140 is such that it can be positioned within or at least partially within the visual element recess 112. In an exemplary, nonlimiting embodiment, the visual element 140 comprises a 0.04 inch or a 0.06 inch diameter colored optic rod.

In certain exemplary embodiments, the visual element 140 comprises a self-illuminating material or a fiber optic material. The visual element 140 may optionally provide illumination by photoluminescence, phosphorescence, fluorescence, or chemiluminescence.

In certain exemplary embodiments, the visual element 140 comprises a rod or element having a luminous phosphorescent paint applied to at least a portion of the exterior surface of the rod or element.

In certain exemplary embodiments, the visual element 140 comprises a non-luminescent rod or element. The visual element 140 may optionally be colored or at least partially colored to provide a visually discernible contrast between the visual element 140 and other surfaces of the lever element 110. The visual element 140 may optionally comprise a material, such as, for example, steel, stainless steel, copper, brass, or the like, which provides a visually discernible contrast between the visual element 140 and other surfaces of the lever element 110.

A primary viewing aperture 132 extends, along at least a portion of the extension portion 130, from the extension portion top wall 131 to at least a portion of the visual element recess 112. The primary viewing aperture 132 extends so as to allow light from a visual element 140, positioned within the visual element recess 112, to emanate or radiate from the visual element recess 112, through the primary viewing aperture 132.

Figure 14:
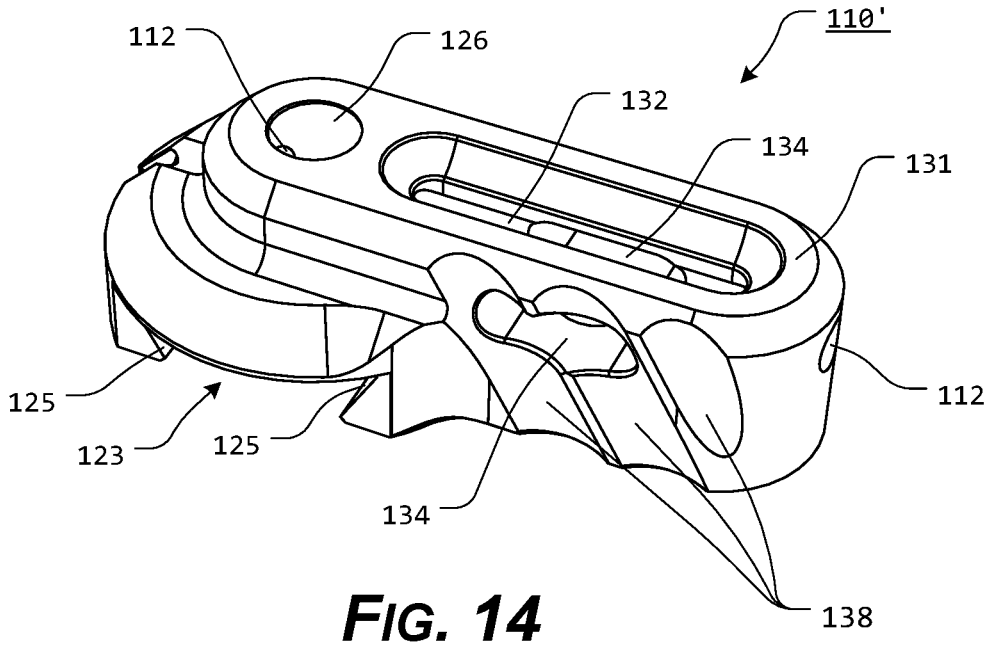
FIG. 14 illustrates an upper, rear perspective view of an exemplary embodiment of a safety selector lever element, according to the present disclosure.

In certain exemplary embodiments, one or more secondary viewing apertures 134 extend, along at least a portion of the extension portion 130, from one or both of the extension portion sidewalls 133 to at least a portion of the visual element recess 112. The secondary viewing apertures 134 extend so as to allow light from a visual element 140, positioned within the visual element recess 112, to emanate or radiate from the visual element recess 112, through the secondary viewing apertures 134. As illustrated in FIGS. 1-13, two secondary viewing apertures 134 are formed in each extension portion side wall 133. Optionally, the secondary viewing apertures 134 are formed directly across from one another and each extends through a portion of the visual element recess 112. Alternatively, as illustrated in FIGS. 14-15, the lever element 110' only includes a single secondary viewing aperture 134 is formed in each extension portion side wall 133.

Figure 15:
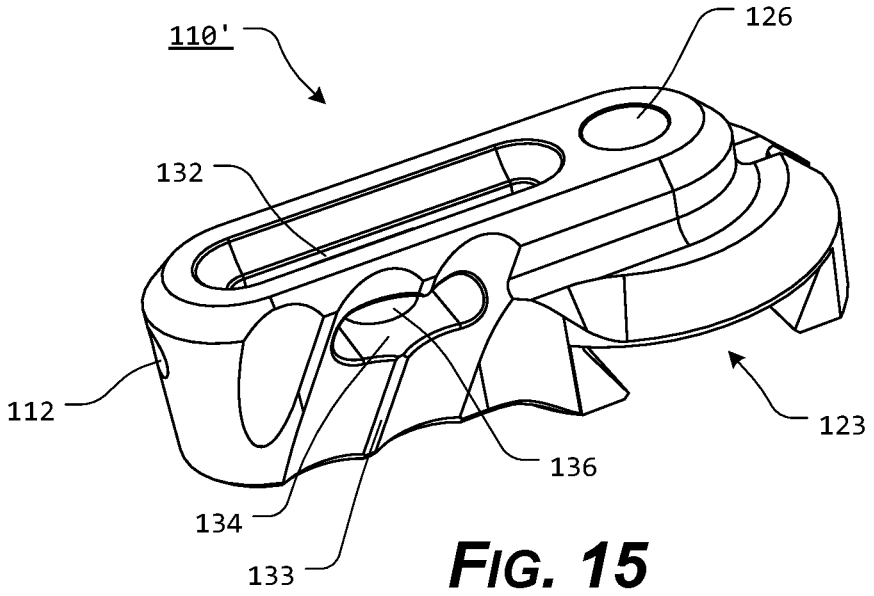
FIG. 15 illustrates an upper, side perspective view of an exemplary embodiment of a safety selector lever element, according to the present disclosure.
Figure 16:
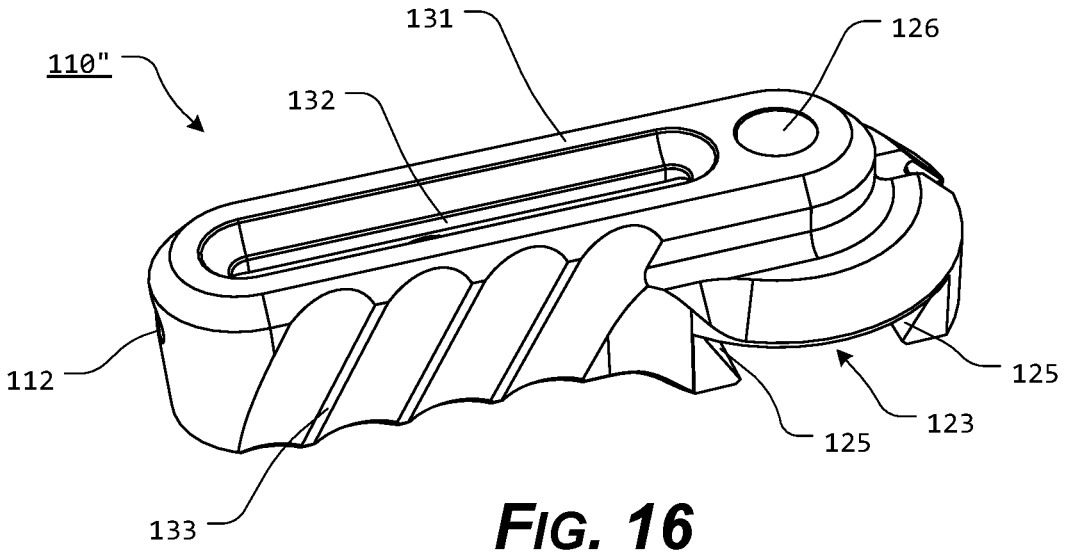
FIG. 16 illustrates an upper, side perspective view of an exemplary embodiment of a safety selector lever element, according to the present disclosure.
Figure 17:
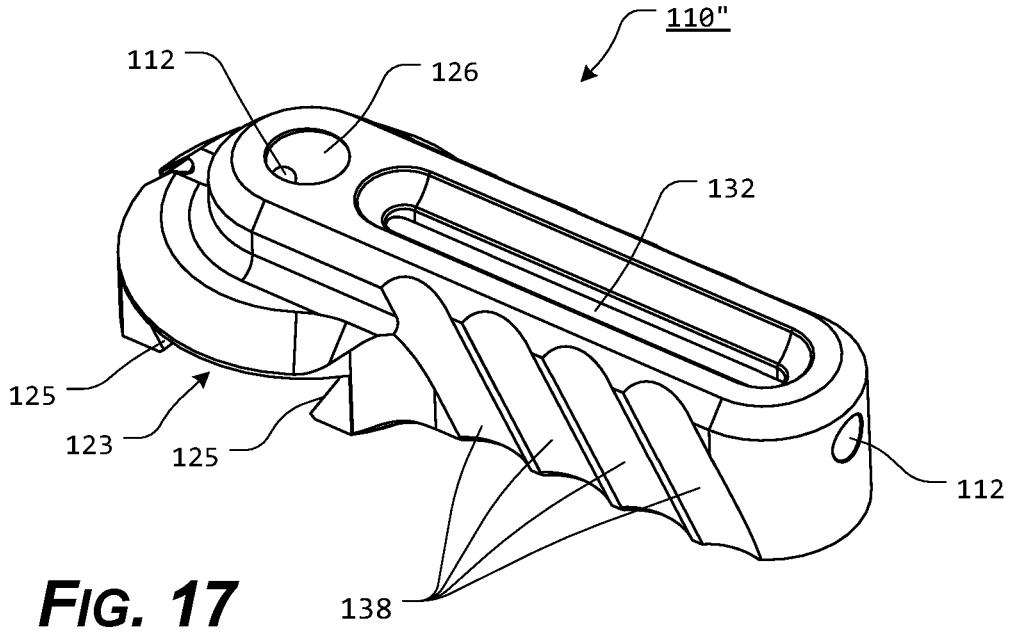
FIG. 17 illustrates an upper, rear perspective view of an exemplary embodiment of a safety selector lever element, according to the present disclosure.
Figure 18:
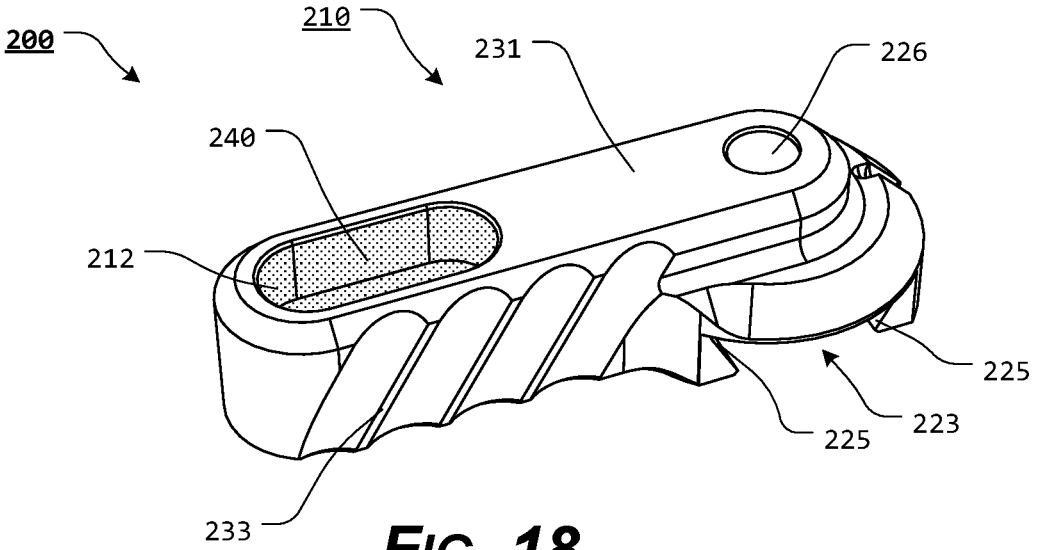
FIG. 18 illustrates an upper, side perspective view of an exemplary embodiment of a safety selector lever, according to the present disclosure.
Figure 19:
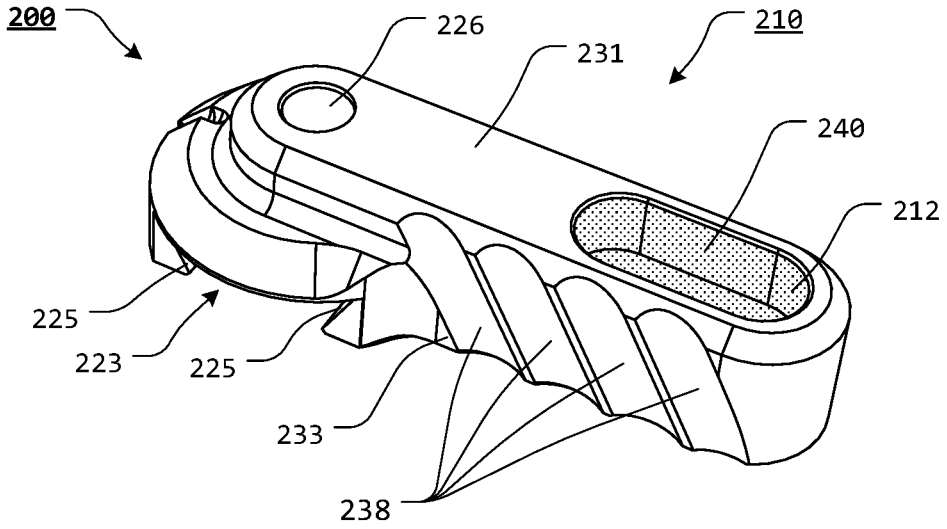
FIG. 19 illustrates an upper, rear perspective view of an exemplary embodiment of a safety selector lever, according to the present disclosure.
Figure 20:
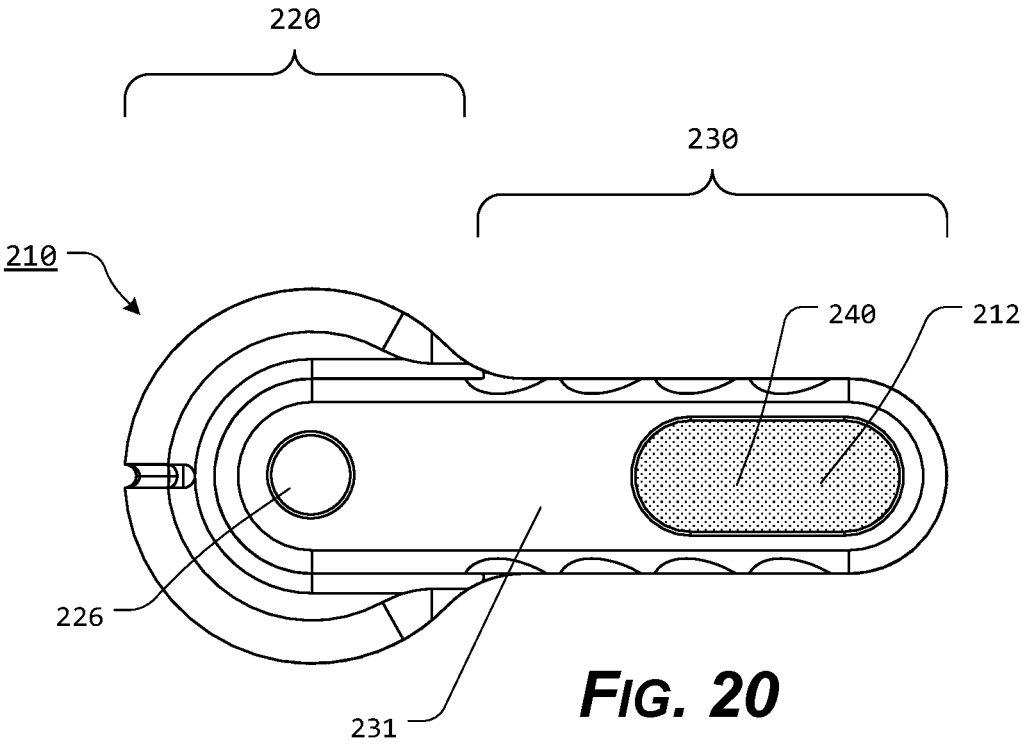
FIG. 20 illustrates a top view of an exemplary embodiment of a safety selector lever, according to the present disclosure.
Figure 21:
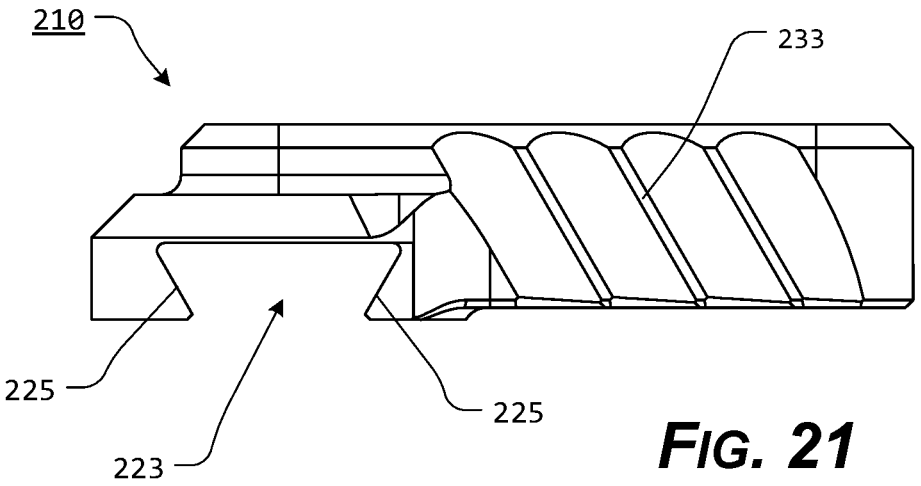
FIG. 21 illustrates a side view of an exemplary embodiment of a safety selector lever, according to the present disclosure.
Figure 22:
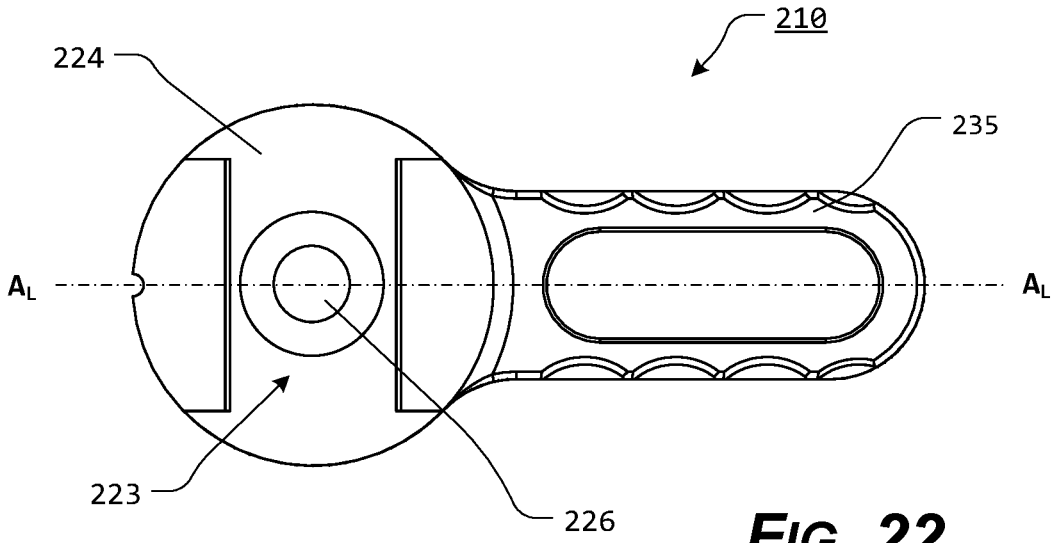
FIG. 22 illustrates a bottom view of an exemplary embodiment of a safety selector lever, according to the present disclosure.
Figure 23:
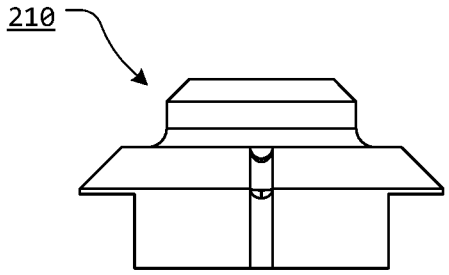
FIG. 23 illustrates a front view of an exemplary embodiment of a safety selector lever, according to the present disclosure.
Figure 24:
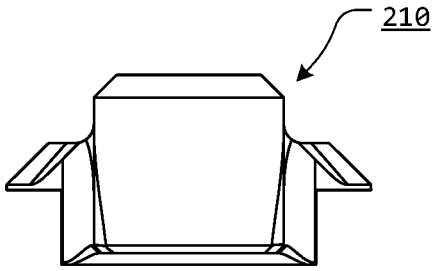
FIG. 24 illustrates a rear view of an exemplary embodiment of a safety selector lever, according to the present disclosure.
Figure 25:
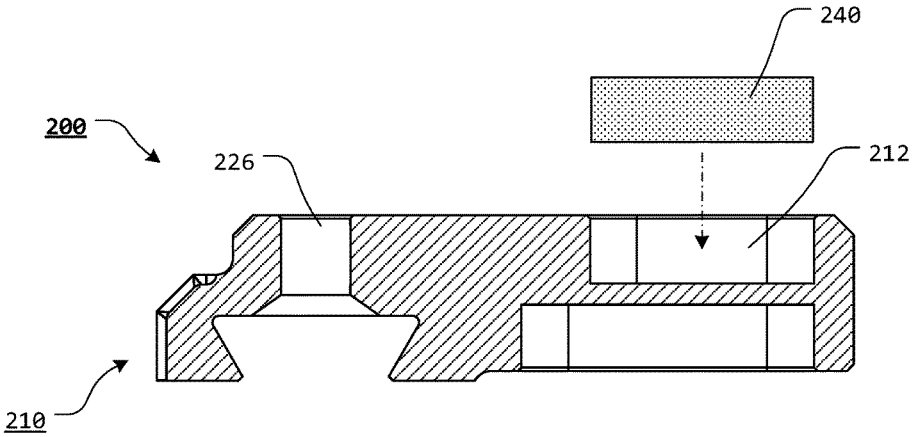
FIG. 25 illustrates a side, cross-sectional, exploded view of an exemplary embodiment of a safety selector lever, according to the present disclosure.

As illustrated in FIGS. 15-16, the lever element 110" only includes a primary viewing aperture 132 and does not include any secondary viewing apertures 134. It should also be understood and appreciated that the lever element 110 may only include secondary viewing apertures and not include a primary viewing aperture. Thus, it should be appreciated that the number and placement of any primary viewing apertures and/or secondary viewing apertures is a design choice, based upon the desired illumination level and/or functionality of the safety selector lever 100.

In various exemplary embodiments, the lever element 110 is substantially rigid and formed of stainless steel. Alternate materials of construction of the lever element 110 may include one or more of the following: steel, aluminum, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the lever element 110 is a design choice based on the desired appearance and functionality of the lever element 110.

It should be appreciated that certain elements of the lever element 110 may be formed as an integral unit (such as, for example, the head portion 120 and the extension portion 130). Alternatively, suitable materials can be used and sections or elements made independently and attached or coupled together, such as by adhesives, welding, screws, rivets, pins, or other fasteners, to form the various elements of the lever element 110.

It should also be understood that the overall size and shape of the lever element 110 is a design choice based upon the desired functionality and/or appearance of the lever element 110.

During assembly of the safety selector lever 100, as illustrated most clearly in FIGS. 10-13, the visual element 140 is aligned with and urged into the visual element recess 112. Once the visual element 140 is appropriately positioned within the visual element recess 112, the securing screw 150, which may already be at least partially threadedly inserted within the securing screw aperture 136, is further threadedly inserted within the securing screw aperture 136 and rotated (typically clockwise) so as to be moved from the disengaged position, with the terminal end of the securing screw 150 positioned flush or outside of the visual element recess 112, to the engaged position. In the disengaged position, the securing screw 150 does not interfere with the ability of the visual element 140 to be slidably inserted within the visual element recess 112. When rotated to the engaged position, at least a terminal end of the securing screw 150 is urged against a portion of the visual element 140 to further assist in maintaining the visual element 140 within the visual element recess 112 and resist slidable movement of the visual element 140 relative to the visual element recess 112.

In certain exemplary embodiments, the securing screw aperture 136 and the securing screw 150 are not included and the visual element 140 may be retained within the visual element recess 112 via frictional engagement between one or more exterior surfaces of the visual element 140 and one or more surfaces defining of the visual element recess 112. Additionally, the visual element 140 may be retained within the visual element recess 112 via, for example, an adhesive or mushrooming of terminal ends of the visual element 142 maintain the visual element 140 within the visual element recess 112.

If a user desires to remove and/or replace a visual element 140, the securing screw 150 is rotated from the engaged position to the disengaged position. Once the securing screw 150 is in the disengaged position, the visual element 140 can be slidably removed from the visual element recess 112 and replaced, if desired, by an alternative visual element 140.

It should also be appreciated that a more detailed explanation of the specific dimensions of certain components of the safety selector lever 100, instructions regarding how to install the safety selector lever 100, methods for using the safety selector lever 100, once installed, and certain other items and/or techniques necessary for the implementation and/or operation of the various exemplary embodiments of the present disclosure are not provided herein because such background information will be known to one of ordinary skill in the art. Therefore, it is believed that the level of description provided herein is sufficient to enable one of ordinary skill in the art to understand and practice the systems, methods, and apparatuses of the presentation, as described.

It should be appreciated that the compression screw attachment system of the present disclosure is not limited to the embodiment illustrated and described as the safety selector lever 100. For example, FIGS. 18-27 illustrate certain components, elements, and/or aspects of certain exemplary embodiments of the safety selector lever 200, according to the present disclosure. The safety selector lever 200 comprises at least some of a lever element 210, a head portion 220, an attachment element 223, a recess bottom wall 224, recess sidewalls 225, an extension portion 230, an extension portion top wall 231, extension portion side walls 233, an extension portion bottom wall 235, and optionally including diagonal grooves 238.

It should be appreciated that these elements correspond to and operate similarly to the lever element 210, the head portion 220, the attachment element 223, the recess bottom wall 224, the recess sidewalls 225, the extension portion 230, the extension portion top wall 231, the extension portion side walls 233, the extension portion bottom wall 235, and the optional diagonal grooves 238, as described, with reference to the safety selector lever 100.

Figure 26:
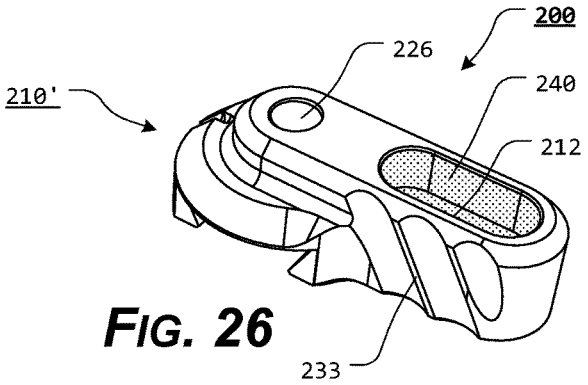
FIG. 26 illustrates an upper, rear perspective view of an exemplary embodiment of a safety selector lever, according to the present disclosure.
Figure 27:
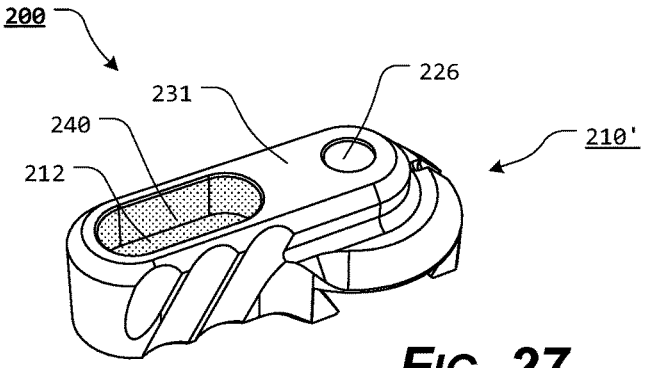
FIG. 27 illustrates an upper, rear perspective view of an exemplary embodiment of a safety selector lever, according to the present disclosure.

As discussed with reference to the safety selector lever 100, the length of the extension portion may vary, as illustrated by the varied length when comparing the lever element 210 of FIGS. 18-25 and the lever element 210' of FIGS. 26-27.

However, as illustrated FIGS. 18-27, the lever element 210 includes a visual element recess 212 that extends from the extension portion top wall 231 toward the extension portion bottom wall 235. The visual element recess 212 is formed so as to allow a visual element 240 to be positioned therein. The visual element 240 transmits light either by self-illumination or by concentrating ambient light. In various exemplary embodiments, the visual element 240 may comprise a substance which can absorb energy and release the energy in the form of light. For example, the visual element 240 may optionally provide illumination by photoluminescence, phosphorescence, fluorescence, chemiluminescence. In certain exemplary embodiments, the visual element 240 may comprise a self-illuminating material, such as, for example, tritium or tritium gas, encased within a cylinder. Alternatively, the visual element 240 may comprise a fiber optic portion that is able to collect ambient light and concentrate the collected light to "glow". It should be appreciated that the overall size and shape of the visual element 240 is such that it can be positioned within or at least partially within the visual element recess 210.

The visual element 240 is positioned within the visual element recess 212. In various exemplary embodiments, the visual element 240 is maintained within the visual element recess 212 via frictional engagement between outer surfaces of the visual element 240 and surfaces defining the visual element recess 212. Alternatively, the visual element 240 may be attached or coupled within the visual element recess 212, such as by adhesives or fastening elements, to maintain the visual element 240 within the visual element recess 212.

While the present disclosure has been described in conjunction with the exemplary embodiments outlined above, the foregoing description of exemplary embodiments, as set forth above, are intended to be illustrative, not limiting and the disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A firearm safety selector lever, comprising:

a lever element having a head portion and an extension portion, wherein said head portion includes an attachment element, wherein said extension portion includes an extension portion top wall, two extension portion sidewalls, and an extension portion bottom wall, wherein a visual element recess is formed through at least a portion of said extension portion, wherein a primary viewing aperture extends from said extension portion top wall to at least a portion of said visual element recess, and wherein a securing screw aperture extends from said extension portion bottom wall to said visual element recess;

a visual element, wherein said visual element comprises an illuminating material or a fiber optic material and is at least partially positionable within said visual element recess; and a securing screw rotatably engageable within at least a portion of said securing screw aperture, such that a terminal end of said securing screw extends to contact at least a portion of said visual element within said visual element recess.

2. The safety selector lever of claim 1, wherein said attachment element is defined by one or more recess sidewalls and a recess bottom wall.

3. The safety selector lever of claim 1, wherein said attachment element is mateable with a portion of a selector core.

4. The safety selector lever of claim 1, wherein said extension portion extends from said head portion.

5. The safety selector lever of claim 1, wherein a portion of said extension portion overlaps at least a portion of said head portion.

6. The safety selector lever of claim 1, wherein a plurality of diagonal grooves are formed within a portion of said extension portion sidewalls of said lever element.

7. The safety selector lever of claim 1, wherein said visual element recess extends through said entire extension portion, along said longitudinal axis of said extension portion.

8. The safety selector lever of claim 1, wherein said visual element recess extends along said longitudinal axis of said extension portion.

9. The safety selector lever of claim 1, wherein at least a portion of a sidewall of said visual element recess includes a surface preparation that provides a reflective or partially reflective surface.

10. The safety selector lever of claim 1, wherein said visual element is an illuminating material and provides illumination by photoluminescence, phosphorescence, fluorescence, chemiluminescence.

11. The safety selector lever of claim 1, wherein said visual element is an illuminating material and comprises tritium or tritium gas, encased within a cylinder.

12. The safety selector lever of claim 1, wherein said visual element comprises a fiber optic strand or cylinder.

13. The safety selector lever of claim 1, wherein said primary viewing aperture extends so as to allow light from said visual element, when positioned within said visual element recess, to emanate or radiate from said visual element recess, through said primary viewing aperture.

14. The safety selector lever of claim 1, further comprising one or more secondary viewing apertures, wherein each secondary viewing aperture extends from one or both of said extension portion sidewalls to at least a portion of said visual element recess.

15. The safety selector lever of claim 14, wherein said secondary viewing apertures extend so as to allow light from said visual element, when positioned within said visual element recess, to emanate or radiate from said visual element recess, through said secondary viewing apertures.

16. A firearm safety selector lever, comprising:

a lever element having an extension portion, wherein said extension portion includes an extension portion top wall, two extension portion sidewalls, and an extension portion bottom wall, wherein a visual element recess is formed through at least a portion of said extension portion, wherein a primary viewing aperture extends from said extension portion top wall to at least a portion of said visual element recess, wherein at least one secondary viewing aperture extends from one or both of said extension portion sidewalls to at least a portion of said visual element recess, and wherein a securing screw aperture extends from said extension portion bottom wall to said visual element recess;

a visual element, wherein said visual element comprises an illuminating material or a fiber optic material and is at least partially, removably positioned within said visual element recess; and a securing screw rotatably engageable within at least a portion of said securing screw aperture, such that a terminal end of said securing screw extends to contact at least a portion of said visual element.

17. The safety selector lever of claim 16, wherein said visual element comprises a self-illuminating material.

* * * * *